US006527882B1

(12) United States Patent
Wehage et al.

(10) Patent No.: US 6,527,882 B1
(45) Date of Patent: Mar. 4, 2003

(54) METHOD AND INSTALLATION FOR THE CONTINUOUS PRODUCTION OF HOT-ROLLED, THIN FLAT PRODUCTS

(75) Inventors: Harald Wehage, Ilsenburg (DE); Ulrich Skoda-Dopp, Duisburg (DE); Horst Jacobi, Erkrath (DE)

(73) Assignees: SMS Demag AG, Düsseldorf (DE); Salzgitter AG, Salzgitter (DE)

( * ) Notice: Subject to any disclaimer, the term of this patent is extended or adjusted under 35 U.S.C. 154(b) by 0 days.

(21) Appl. No.: 09/581,864

(22) PCT Filed: Nov. 3, 1998

(86) PCT No.: PCT/DE98/03259

§ 371 (c)(1),
(2), (4) Date: Aug. 15, 2000

(87) PCT Pub. No.: WO99/30847

PCT Pub. Date: Jun. 24, 1999

(30) Foreign Application Priority Data

Dec. 17, 1997 (DE) ..... 197 58 108

(51) Int. Cl.[7] ..... C21D 8/02
(52) U.S. Cl. ..... 148/541; 148/602
(58) Field of Search ..... 148/602, 541, 148/546, 653

(56) References Cited

U.S. PATENT DOCUMENTS 5,567,250 A * 10/1996 Akamatsu et al. ..... 148/541
5,802,902 A * 9/1998 Rosenthal et al. ..... 72/201
6,290,787 B1 * 9/2001 Babbit et al. ..... 148/541

FOREIGN PATENT DOCUMENTS

JP 62234613 * 10/1987
JP 08309406 * 11/1996

OTHER PUBLICATIONS

Patent Abstracts of Japan, Abstract of JP 62234613, Oct. 1987.*

Patent Abstracts of Japan, Abstract of JP 08309406, Nov. 1996.*

* cited by examiner

*Primary Examiner*—Scott Kastler
(74) *Attorney, Agent, or Firm*—Cohen, Pontani, Lieberman & Pavane

(57) ABSTRACT

A method and an installation for the endless production of hot-rolled, flat products from thin cast strip. The installation includes a casting machine for producing cast strip, a device for cooling the cast strip under inert gas, a single-stand roughing train, a multi-stand finishing train, a device for cooling, heating or maintaining the temperature of the hot-rolled strip, according to choice, between the roughing train and the finishing train, shears for separating the hot-rolled strip from coil to coil, a delivery roller table with devices for cooling the hot-rolled strip and with coiling machines arranged downstream of the finishing train for coiling up the finished strip.

16 Claims, 1 Drawing Sheet

METHOD AND INSTALLATION FOR THE CONTINUOUS PRODUCTION OF HOT-ROLLED, THIN FLAT PRODUCTS

PRIORITY CLAIM

This is a U.S. national stage of application No. PCT/DE98/03259, filed on Nov. 3, 1998. Priority is claimed on that application and on the following application:

Country: Germany, Application No.: 197 58 108.0, Filed: Dec. 17, 1997.

BACKGROUND OF THE INVENTION

1. Field of the Invention

The invention relates to a method and an installation for the endless production of hot-rolled, thin flat products from thin cast strip, comprising a single-stand roughing train, a multi-stand finishing train, a delivery roller table with devices for cooling the hot-rolled strip and coiling machines arranged upstream and downstream of the cooling devices for coiling up the hot-rolled strip.

2. Discussion of the Prior Art

For producing hot-rolled strips, slabs with a thickness greater than 120 mm or thin slabs with thicknesses between 40 and 120 mm are used as the starting material. In the case of individual slabs, the rolling installations generally comprise a single- or multi-stand roughing train in which the slabs are reduced in a number of rolling passes in reversing operation, as well as a multi-stand finishing train or a Steckel stand. The approximately uniform temperature over the length of the hot-rolled strip is achieved either by means of a coil box between the roughing train and the finishing train, by speeding up in the finishing train or by coiling furnaces upstream and downstream of the Steckel stand. In these cases, a discontinuous process is concerned, i.e. the roughing train and finishing train generally operate and roll the individual slabs in isolation from each other.

In the case of an installation known from European Reference EP 753 359 A1, the roughed strips of two slabs rolled in the roughing train are welded at the head and foot with the aid of a heating and pressing apparatus between the roughing train and the finishing train. The seam between the two roughed strips is subsequently machined before the roughed strip runs into the finishing train. In the finishing train, it is then endlessly rolled, while the roughing train operates discontinuously. The problems entailed by a seam, of process stability and the quality of the hot-rolled strip in the region of the rolled-out piece of the seam, are disadvantageous. Ferritic or combined austenitic-ferritic rolling are possible only with the micro-structural transformation in the finishing train, with the disadvantages already mentioned.

In the case of thin slabs, a distinction must be drawn between rolling installations which use thin slabs with a thickness of 40 to 65 mm or greater than 65 mm as the starting material.

The former comprise a multi-stand finishing train, a delivery roller table with devices for cooling the hot-rolled strip to coiling temperature and coiling machines for coiling up the hot-rolled strip.

On account of the greater deformation work necessary for the same final thickness, installations for thin slabs>65 mm comprise a single- or multi-stand roughing train with more than one rolling pass and a multi-stand finishing train as well as a delivery roller table with devices for cooling the hot-rolled strip to coiling temperature and coiling machines for coiling up the hot-rolled strip. Between the roughing train and the finishing train there are devices for heating and/or coiling the roughed strip, which ensure the necessary temperature of the hot-rolled strip on entering the finishing train over the length of the hot-rolled strip.

The rolling installations are generally designed and operated in such a way that the deforming in the individual passes takes place in a fully austenitic or else combined austenitic-ferritic process.

In the case of austenitic rolling, the rolling temperature in all the passes is above the GOS line of the iron-carbon diagram, it being intended for the final rolling temperature in the last stands of the finishing train to lie just above the GOS line in order to achieve a fine-grained structure.

In the case of combined austenitic-ferritic rolling of steels with a carbon content of greater than 0.015%, the rolling temperature in the last stands of the finishing train lies below the GOS line in the range of approximately 810 to 890° C. This can be achieved with the same final thickness by lowering the temperature of the slabs on leaving the furnace, as a result of which the proportion of micro-alloying elements in solution is reduced and the quality of the rolled strip is impaired. Lowering the rolling rate without lowering the temperature of the slabs on leaving the furnace is also possible, as a result of which the rolled stock is subjected to more intensive cooling. However, this leads to the disadvantage of reduced production. A combination of the two measures is also possible, with the disadvantages already mentioned.

In the case of ferritic rolling, the lowering of the final rolling temperature to a minimum of 720° C. takes place by means of the measures already mentioned with respect to combined austenitic-ferritic rolling, including their disadvantages. The ferritic range is only reached in the last two or three rolling passes, as a result of which the reduction in this range is small. The transformation point lies (centrally) within the finishing train and is shifted by temperature influences between the stands, which leads to drops in rolling force owing to the lower deformation resistance of the material in the ferritic temperature range. This is disadvantageous for the roll-bending and adjusting systems for ensuring the thickness, profile and contour as well as flatness of the rolled strip, since these systems use the measured rolling force as an output signal.

In German reference DS 196 00 990 A1 it is proposed to cool the rolled strip between the stands of the finishing train at a cooling rate of over 30 K/s for ferritic transformation. Since the micro-structural transformation and the temperature equalization between the core and the surface take time, an equalizing zone of several meters is required after the cooling zone to the next stand. However, this is disadvantageous for austenitic rolling with a final rolling temperature of greater than 890° C.; this is because increasing the distances between the stands increases the temperature losses of the hot-rolled strip.

In European reference EP 0 761 325 A1 there is proposed a second downstream single- or multi-stand rolling train for the ferritic rolling of rolled strip after a multi-stand rolling train with a delivery roller table, devices for cooling the hot-rolled strip and downstream coiling machines for coiling up the austenitically rolled hot-rolled strip. The hot-rolled strip initially austenitically deformed in the first multi-stand rolling train is cooled with the aid of the devices arranged between the two rolling trains for cooling to the ferritic temperature range. The downstream single- or multi-stand rolling train serves exclusively for the ferritic rolling, virtually necessitating two rolling trains, which represents a high level of expenditure on technical equipment.

In European reference EP 0 761 326 A1 there is proposed a production installation comprising a multi-stand rolling train, a delivery roller table with devices for cooling the hot-rolled strip, and downstream coiling machines, in which installation at least the first stand is designed as a reversing stand with at least one coiling furnace arranged upstream and downstream of it. A controllable cooling device is provided between the upstream coiling furnace and the following reversing stand. After the rolling of the hot-rolled strip in the austenitic temperature range, the hot-rolled strip is cooled by means of the controllable cooling device into the ferritic temperature range and is coiled up in the coiling furnace. The micro-structural transformation takes place in the coiling furnace. The rolling is subsequently performed in reversing mode through the rolling train downstream of the coiling furnace, in the ferritic temperature range. During the austenitic rolling, cooling is not carried out. The hot-rolled strip may be heated by means of a heating apparatus between the rolling trains. Various arrangements of stands and coiling furnaces are proposed. The characterizing feature in any event is the reversing operation, as a result of which the proposed production installation cannot perform endless, continuous rolling. The additionally necessary coiling furnace or furnaces increase the expenditure on technical equipment.

Also known are production installations for the rolling of hot-rolled strip from thin slabs in which devices for cooling and heating are arranged downstream of a single-or multi-stand roughing train. These devices are followed by a multi-stand finishing train with a delivery roller table, devices for cooling and coiling machines for coiling up the hot-rolled strip. Generally at least two rolling passes in the austenitic temperature range are performed in the roughing train, either in a number of stands in continuous operation or in a single stand in reversing operation. In the case of ferritic or combined austenitic-ferritic rolling, the hot-rolled strip is cooled to the temperature of the respective temperature range in the devices for cooling between the roughing train and the finishing train and subsequently finish-rolled in the finishing train in a ferritic or combined austenitic-ferritic process. During the austenitic rolling, the hot-rolled strip is intermediately heated or maintained at the same temperature in devices for heating between the roughing train and the finishing train, in order to allow austenitic finish-rolling as well in the finishing train. Individual thin slabs or a melt cast into a long thin slab are rolled, the weight of the long thin slab corresponding to a multiple of an individual thin slab, i.e. in both cases there is an interruption in the rolling process.

All the known or proposed production installations share the common feature that the starting material runs through a furnace or an inductive heating system for the purpose of heating or temperature equalization over thickness and width or homogenization of the starting material before rolling.

The known production installations require devices for descaling the starting material before the first pass and before the finishing train. The necessity for descaling the starting material before the first pass arises as a result of the scaling of the surface of the starting material as it runs through a pre-heating, equalizing or homogenizing furnace or an inductive heating system. The necessity for descaling before the finishing train arises as a result of the secondary scaling of the hot-rolled strip in the region of the roughing train and between the roughing train and the finishing train.

The production process in the case of the known or proposed production installations is discontinuous or, in the case of welding hot-rolled strip after the roughing train, endlessly continuous only in the finishing train.

All the known or proposed production installations share the common feature that, on account of the discontinuity of the process, there are disadvantageous sudden increases in load during the introduction of the starting material into the stands of the roughing or finishing train and during the introduction of the hot-rolled strip rolled in the roughing train into the finishing train as well as during the running of the finish-rolled hot-rolled strip into the coiling machines. As a result, there is increased wear of parts of the installation and their service life is reduced.

Roll gap lubrication in the stands of the roughing and finishing trains of known production installations can be used only after introduction of the starting material or the hot-rolled strip into the respective stand, since otherwise the gripping condition is not ensured. The reduction in the friction between the rolled stock and the roll associated with roll gap lubrication leads to a reduction in the deformation resistance and, as a result, a reduction in the rolling force, the roll torque and the required drive power. The surface quality of the rolled strip is increased. However, these advantages are not obtained for the leading piece of the rolled strip, which after rolling out accounts for a considerable part of the length of the strip. Moreover, the production installations must be designed to cope with the loading conditions that are encountered without roll gap lubrication.

Finally, all known or proposed production installations share the common feature that there are disadvantageous restrictions in the quality over the length of the hot-rolled strip on account of the discontinuity of the process, since the production installations have to be readjusted each time a slab, thin slab or the rolled strip is introduced.

SUMMARY OF THE INVENTION

With this prior art, the object of the invention is to provide a production installation for the austenitic, combined austenitic-ferritic and ferritic rolling of thin rolled strip in an endless, fully continuous process with which the disadvantages and problems mentioned above are eliminated and on which all three aforementioned technologies can be realized.

The object is achieved according to the invention with a production installation of the type mentioned at the beginning by the strip cast in a thickness of 5–18 mm being cooled in a controlled manner under an inert gas atmosphere before reaching the single-stand roughing train and by the hot pre-rolled strip being cooled, heated or its temperature maintained, according to choice, in a controlled manner in a device downstream of the roughing train and by the edges of the hot-rolled strip being subsequently heated.

The production method is specifically designed for the rolling of thin cast strip on the basis of all three possible technologies, i.e. austenitic, austenitic-ferritic and ferritic rolling. From the thin cast strip it is possible to produce strip material in small thicknesses endlessly and fully continuously in both an austenitic and a ferritic process as well as a combined austenitic-ferritic process, with a total reduction of at least 65% with respect to the overall installation.

All that is required, according to requirements, are two-high, four-high or six-high stands with working roll diameters of 300 to 900 mm as well as the actuators and control loops customary in hot and cold rolling processes for specifically selective temperature control and for ensuring the required finished product tolerances for thickness, profile, flatness and material and mechanical properties.

According to the invention, the rolling temperature in the austenitic range is set in the single-stand roughing train by variably controlled cooling of the cast strip upstream of the roughing train. With the specifically selective cooling of the fully solidified cast strip of a thickness of 5 to 18 mm under a controllable inert gas atmosphere, the technologically required characteristic variables of temperature, starting austenitic grain size, degree of scaling and chemical composition of the scale are set before the first rolling pass.

It is preferably provided that carbon steels, low-alloyed steels, low-carbon steels and micro-alloyed steels re-crystallize by a material-dependent reduction of 45 to 70% in the single-stand roughing train, in conjunction with the rolling temperature that can be variably set in the austenitic range and the cooling, heating or temperature maintenance that follows the deforming, by the time they enter the multi-stand finishing train, and the initial grain size of the cast strip is greatly reduced, at least halved, with only one pass.

In a further refinement of the invention, it is provided that the rolling temperature upstream of the multi-stand finishing train can be set in a specifically selective manner by the device arranged downstream of the roughing train for controllably cooling, heating or maintaining the temperature of the hot-rolled strip, according to choice, in the austenitic or ferritic range or in the transitional range from austenite to ferrite.

A material-dependent overall reduction of greater than 50% in the multi-stand finishing train in conjunction with the rolling temperature that can be set in a specifically selective manner has the effect according to the invention of producing in the hot-rolled strip a fine-grained structure of the grain size classes 6–10 according to DIN 50601.

The rolling temperature, which can be variably set by means of cooling, the material-dependent high reduction of 45–70% in the single-stand roughing train and the variably controllable cooling, heating or maintaining of the temperature of the hot-rolled strip have the effect that the hot-rolled strip is re-crystallized before it enters the finishing train and the starting grain size of the cast strip is greatly reduced.

Furthermore, it is provided that the hot-rolled strip that has been rolled in a ferritic endless and combined austenitic-ferritic endless, fully continuous process is coiled up in thermally insulated coiling machines immediately after leaving the last stand of the multi-stand finishing train and is subjected to slow cooling that is homogeneous over the width of the coil.

It has been found to be favorable to subject the hot-rolled strip that has been rolled in an austenitic endless, fully continuous process initially to forced cooling from above after it leaves the last stand of the multi-stand finishing train and then to subject the hot-rolled strip to cooling to coiling temperature as it undergoes specifically selective microstructural transformation.

Since, according to the invention, the thin cast strip is provided with a starting piece, it is proposed that the starting piece should pass the opened stands of the roughing train and the multi-stand finishing train in an undeformed state in the rolling direction and be separated from the rest of the cast strip by the shears.

It is favorable if, after the starting piece of the thin cast strip has been separated by means of the shears, the opened stands of the roughing train and the multi-stand finishing train are closed to the roll gaps intended for the rolling of the required final thickness and the piece of hot-rolled strip rolled during the closing operation is either chopped with the aid of shears or coiled up by means of coiling machines.

For reducing the friction between the rolled stock and the roll, and thereby reducing the rolling forces, roll torques and drive power, and for increasing the surface quality over the entire length of the hot-rolled strip, it is proposed according to another feature of the invention for the rolls already to be lubricated during the closing of the opened stands of the single-stand roughing train and the multi-stand finishing train to the roll gaps intended for the rolling of the required final thickness.

If the roll gap lubrication takes place according to the invention during the entire rolling time, the wearing of the working rolls is reduced, whereby the thickness and profile are improved over the entire length of the hot-rolled strip and the service life of the rolls is increased.

According to the invention, after closing the roll gaps of the single-stand roughing train and the multi-stand finishing train to the values intended for rolling the required final thickness and after using the shears to chop the piece of hot-rolled strip rolled during the closing operation, it is intended that the steady state of fully continuous endless rolling of thin cast strip should have been reached and the hot-rolled strip that has been rolled in an austenitic, combined austenitic-ferritic or ferritic process should be separated by means of the shears into coil lengths.

It is favorable if, to increase the edge quality and profile accuracy of the hot-rolled strip, the edges of the thin cast strip are deformed in a vertical stand flange-mounted on the single-stand roughing train by special edging passes with low reduction before the horizontal pass and at the same time the thin cast strip runs centrally into the single-stand roughing train.

The fact that the starting material or the hot-rolled strip is rolled without reversing, on account of the endless, fully continuous production process, makes it possible to dispense with repeated introductions and the associated sudden increases in load.

Because the production installation is adjusted only once after starting up, on account of the endless, fully continuous production process, a constantly high quality of the hot-rolled strip can be achieved over its length.

Finally, the invention provides that the degree of scaling on the surface of the starting material and the chemical composition of the scale is set in a specifically selective manner by the controllable cooling of the cast strip under inert gas atmosphere up until the first rolling pass.

The invention provides an overall installation concept with which a fully continuous endless rolling process can he realized in a optimum way, the process allowing all three possible rolling technologies for the production of hot-rolled strip, i.e. austenitic, combined austenitic-ferritic and ferritic rolling.

BRIEF DESCRIPTION OF THE DRAWINGS

The single drawing is a schematic representation of the present invention.

DETAILED DESCRIPTION OF THE PREFERRED EMBODIMENTS

Figure 1:
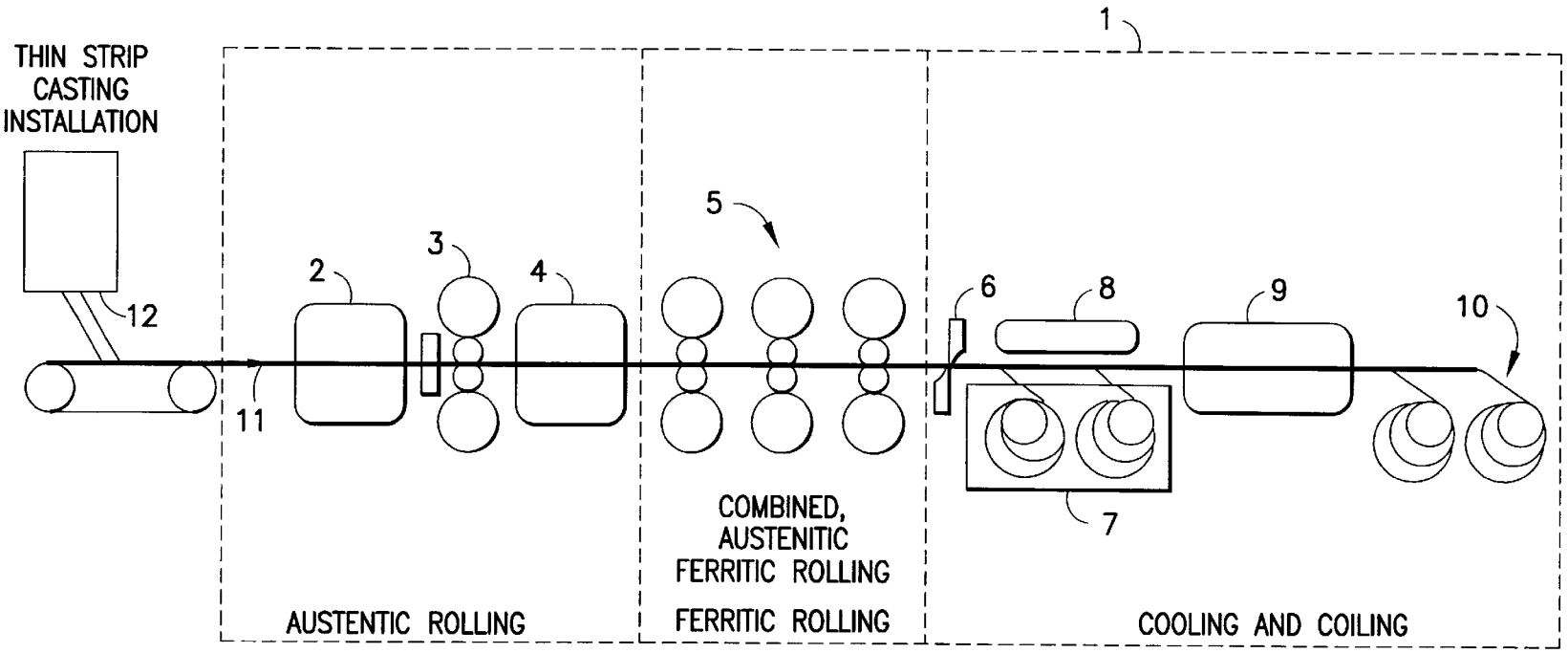

A production installation 1 with which it is possible from a thin cast strip to produce strip material in small thicknesses endlessly and fully continuously in both an austenitic and a ferritic process as well as a combined austenitic-ferritic process, with a total reduction of at least 65% with respect to the overall installation, is represented in the single figure of the drawing. It comprises a thin-slab casting installation 12, a first device 2 for cooling the cast strip under inert gas, a single-stand roughing train 3, a multi-stand finishing train 5, a second device 4 for cooling, heating or maintaining the temperature of the hot-rolled strip, according to choice, between the roughing train 3 and the finishing train 5, shears 6 for separating the hot-rolled strip from coil to coil, a delivery roller table with devices 8,9 for cooling the hot-rolled strip and coiling machines 10, arranged downstream of the finishing train 5, for coiling up the finished strip.

The sequence of the rolling process begins with the specifically selective cooling of the fully solidified cast strip of the thickness of 5 to 18 mm under a controllable inert gas atmosphere, whereby the technologically required characteristic variables of temperature, starting austenitic grain size, degree of scaling and chemical composition of the scale can be set before the first rolling pass.

The starting piece of the thin cast strip runs through the opened stands of the single-stand roughing train 3 and the multi-stand finishing train 5 in an undeformed state in the rolling direction 11, and the shears 6 arranged downstream of the finishing train 5 are used to separate it from the rest of the cast strip with one or more cuts. After that, the opened stands of the single-stand roughing train 3 and the multi-stand finishing train 5 are closed to the rolling gaps intended for rolling the required final thickness and the piece of hot-rolled strip rolled during the closing operation is chopped with the aid of the shears 6 or else also coiled up by means of coiling machines 7 or 10.

Roll gap lubrication may be commenced already during the closing of the stands to the roll gaps intended for rolling the required final thickness, since the gripping condition is ensured because of the constantly increasing reduction up to the final roll gap position.

The starting material is rolled endlessly in the single-stand roughing train 3 with a material-dependent reduction of 45 to 70% for carbon steels, low-alloyed steels, low-carbon and micro-alloyed steels in a horizontal pass in the austenitic temperature range.

The edges of the cast strip are slightly deformed by means of special edging passes upstream of the horizontal pass in a vertical stand flange-mounted upstream of the single-stand roughing train 3, whereby the cast strip at the same time runs centrally into the single-stand roughing train.

After the roughing train, the hot-rolled strip runs through the device 4 for controllably cooling, heating or maintaining the temperature, whereby the temperature of the hot-rolled strip before entering the multi-stand finishing train 5 can be set in a specifically selective manner in the austenitic or ferritic range or in the transitional range from austenite to ferrite.

The rolling temperature, which can be variably set by means of the cooling device 2, the material-dependent high reduction of 45–70% in the single-stand roughing train 3 and the temperature of the hot-rolled strip, which can be set variably by means of the device 4 for controllably cooling, heating or maintaining the temperature, have the effect that the hot-rolled strip is re-crystallized before it enters the finishing train and the starting grain size of the cast strip is greatly reduced.

In the multi-stand finishing train, the hot-rolled strip is rolled with a material-dependent total reduction of greater than 50% into thin hot-rolled steel, whereby in conjunction with the rolling temperature that can be set in a specifically selective manner a fine-grained structure is obtained after rolling.

Immediately after the finishing train, the hot-rolled strip rolled in a ferritic process and rolled in a combined austenitic-ferritic process in an endless, fully continuous manner is coiled up in thermally insulated coiling machines 7.

After leaving the finishing train 5, the hot-rolled strip rolled in an austenitic, endless and fully continuous process initially runs through the a cooling zone 8 with forced cooling from above and then through a device for cooling the hot-rolled strip to coiling temperature with specifically selective micro-structural transformation.

The production installation Is corrected only once after starting up, whereby a constantly high quality of the rolled strip is achieved over its length in the endless fully continuous process.

The invention is not limited by the embodiments described above which are presented as examples only but can be modified in various ways within the scope of protection defined by the appended patent claims.

What is claimed is:

1. A method for the endless production of hot-rolled, flat products from thin cast strip on an installation comprising a single-stand roughing train, a multi-stand finishing train, a delivery roller table with devices for cooling the hot-rolled strip and upstream and downstream coiling machines for coiling up the hot-rolled strip, the method comprising the steps of: cooling the strip cast in a thickness of 5–18 mm in a controlled manner under an inert gas atmosphere before reaching the single-stand roughing train so that no other method steps take place between the cooling of the strip in the inert gas and the introduction of the strip to the roughing train; one of selectively cooling, heating and maintaining the temperature of the hot pre-rolled strip in a controlled manner in a device downstream of the roughing train; and subsequently heating edges of the hot-rolled strip.

2. A production method as defined in claim 1, including setting the rolling temperature in the austenitic range in the single-stand roughing train by variably controlled cooling of the cast strip upstream of the roughing train.

3. A production method as defined in claim 2, including re-crystallizing carbon steels, low-alloyed steels, low-carbon steels and micro-alloyed steels by a material-dependent reduction of 45 to 70% in the single-stand roughing train, in conjunction with the rolling temperature that is variably set in the austenitic range and the one of cooling, heating and temperature maintenance that follows the deforming, by the time the steels enter the multi-stand finishing train, starting grain size of the cast strip being at least halved with only one pass.

4. A production method as defined in claim 2, including setting the rolling temperature upstream of the multi-stand finishing train in a specifically selective manner by the device arranged downstream of the roughing train for controllably and selectively one of cooling, heating and maintaining the temperature of the hot-rolled strip in one of the austenitic range, the ferritic range and the transitional range from austenite to ferrite.

5. A production method as defined in claim 1, wherein a material-dependent overall reduction of greater than 50% in the multi-stand finishing train in conjunction with the rolling temperature that is set in a specifically selective manner produces in the hot-rolled strip a fine-grained structure of grain size classes 6–10 according to DIN 50601.

6. A production method as defined in claim 1, including coiling up the hot-rolled strip that has been rolled in a ferritic endless and combined austenitic-ferritic endless, fully continuous process in thermally insulated coiling machines immediately after leaving a last stand of the multi-stand finishing train, and subjecting the strip to slow cooling that is homogeneous over an entire width of the coil.

7. A production method as defined in claim 1, including initially subjecting the hot-rolled strip that has been rolled in an austenitic endless, fully continuous process to forced cooling from above after it leaves a last stand of the multi-stand finishing train, and then the subjecting the hot-rolled strip to cooling to coiling temperature as the strip undergoes specifically selective micro-structural transformation.

8. A production method as defined in claim 1, including providing the thin cast strip with a starting piece which passes opened stands of the single-stand roughing train and the multi-stand finishing train in an undeformed state in the rolling direction, and separating the starting piece from a remainder of the cast strip with shears.

9. A production method as defined in claim 8, including, after the starting piece of the thin cast strip has been separated by means of the shears, closing the opened stands of the single-stand roughing train and the multi-stand finishing train to the roll gaps intended for the rolling of the required final thickness, and one of chopping and coiling the piece of hot-rolled strip rolled during the closing operation with one of shears and coiling machines.

10. A production method as defined in claim 9, including, for reducing friction between the rolled stock and the roll, and thereby reducing rolling forces, roll torques and drive power, and for increasing surface quality over an entire length of the hot-rolled strip, lubricating the rolls during the closing of the opened stands of the single-stand roughing train and the multi-stand finishing train to the roll gaps intended for the rolling of the required final thickness.

11. A production method as defined in claim 1, including lubricating the roll gap during the entire rolling time.

12. A production method as defined in claim 9, including, after closing the roll gaps of the single-stand roughing train and the multi-stand finishing train to values intended for rolling the required final thickness and after using the shears to chop the piece of hot-rolled strip rolled during the closing operation, reaching steady state of fully continuous endless rolling of thin cast strip and separating the hot-rolled strip that has been rolled in one of an austenitic, a combined austenitic-ferritic and a ferritic process into coil lengths.

13. A production method as defined in claim 1, including deforming edges of the thin cast strip in a vertical stand flange-mounted on the single-stand roughing train by special edging passes with low reduction before a horizontal pass and simultaneously running the thin cast strip centrally into the single-stand roughing train to increase the edge quality and profile accuracy of the hot-rolled strip.

14. A production method as defined in claim 1, including rolling one of a starting material and the hot-rolled strip without reversing.

15. A production method as defined in claim 1, including adjusting the installation only once after starting up, whereby a constantly high quality of the hot-rolled strip is achieved over its length.

16. A production method as defined in claim 1, including setting a degree of scaling on a surface of a starting material and a chemical composition of the scale in a specifically selective manner by the controllable cooling of the cast strip under inert gas atmosphere up until a first rolling pass.

* * * * *